US007992408B2

(12) United States Patent
Bush et al.

(10) Patent No.: US 7,992,408 B2
(45) Date of Patent: Aug. 9, 2011

(54) COMPRESSOR

(75) Inventors: James W. Bush, Skaneateles, NY (US); Wayne P. Beagle, Chittenango, NY (US)

(73) Assignee: Carrier Corporation, Farmington, CT (US)

( * ) Notice: Subject to any disclaimer, the term of this patent is extended or adjusted under 35 U.S.C. 154(b) by 115 days.

(21) Appl. No.: 12/521,223

(22) PCT Filed: Dec. 31, 2006

(86) PCT No.: PCT/US2006/062774
§ 371 (c)(1),
(2), (4) Date: Jun. 25, 2009

(87) PCT Pub. No.: WO2008/082410
PCT Pub. Date: Jul. 10, 2008

(65) Prior Publication Data

US 2010/0095690 A1 Apr. 22, 2010

(51) Int. Cl.
*F25B 39/04* (2006.01)

(52) U.S. Cl. ..... 62/508; 62/498

(58) Field of Classification Search ..... 62/115, 62/498, 323.1, 513, 508; 417/53, 254
See application file for complete search history.

(56) References Cited

U.S. PATENT DOCUMENTS

| | | | | |
|---|---|---|---|---|
| 1,417,571 | A | | 5/1922 | Riesner |
| 2,205,793 | A | | 6/1940 | Hunt |
| 4,974,427 | A | * | 12/1990 | Diab ..... 62/505 |
| 5,674,053 | A | | 10/1997 | Paul et al. |
| 5,716,197 | A | | 2/1998 | Paul et al. |
| 7,096,681 | B2 | | 8/2006 | Wills et al. |
| 2005/0129543 | A1 | | 6/2005 | Collings |
| 2005/0262859 | A1 | | 12/2005 | Crane et al. |

FOREIGN PATENT DOCUMENTS

| | | | |
|---|---|---|---|
| FR | 1366929 | A | 7/1964 |

OTHER PUBLICATIONS

EP Search Report for EP Patent Application No. 06848476.5, dated Apr. 1, 2011.

* cited by examiner

*Primary Examiner* — Melvin Jones
(74) *Attorney, Agent, or Firm* — Bachman & LaPointe, P.C.

(57) ABSTRACT

A compressor has a housing. A crank is carried by the housing for rotation about a crank axis. A cylinder is defined within the housing and has a proximal portion and a distal portion. The distal portion is smaller in transverse cross-sectional area than is the proximal portion. A piston is held within the housing for reciprocal movement at least partially within the cylinder. The piston also has a distal portion smaller in transverse cross-sectional area than a proximal portion. A connecting rod is pivotally coupled to the crank for relative rotation about a proximal axis and to the piston for relative rotation about a distal axis. A first compression chamber exists in the cylinder distal portion beyond the end of the piston. A second compression chamber exists in the cylinder proximal portion beyond a piston shoulder. The first and second compression chambers are non-series and non-parallel.

31 Claims, 5 Drawing Sheets

COMPRESSOR

CROSS-REFERENCE TO RELATED APPLICATION

This is the US national stage of International Application No. PCT/US06/62774, filed Dec. 31, 2006.

BACKGROUND OF THE INVENTION

The invention relates to compressors. More particularly, the invention relates to compressor capacity control.

In the refrigeration compressor art, one broad class of compressors is reciprocating piston compressors. Each of one or more pistons is reciprocally mounted in an associated cylinder. Reciprocation of the piston displaces a given volume of the cylinder to act as a compressor or pump.

In applications requiring small displacement volume and/or high pressures, it is known to use a stepped piston configuration. Such configurations are often termed "crosshead pistons". A relatively small cross-sectional area distal portion of the piston is accommodated in an associated portion of the cylinder. A relatively large cross-sectional area proximal portion may be sized for appropriately robust engagement with an appropriately sized connecting rod. An example of such a configuration is shown in US Patent Application Publication 2005/0129543 A1.

In such a crosshead configuration, the proximal region of the cylinder is typically vented to the compressor sump and is not used for compression. However, one prior proposal to use the proximal area for compression is found in U.S. Pat. No. 5,716,197.

SUMMARY OF THE INVENTION

Accordingly, one aspect of the invention involves a compressor having a housing. A crank is carried by the housing for rotation about a crank axis. A cylinder is defined within the housing and has a proximal portion and a distal portion. The distal portion is smaller in transverse cross-sectional area than is the proximal portion. A piston is held within the housing for reciprocal movement at least partially within the cylinder. The piston also has a distal portion smaller in transverse cross-sectional area than a proximal portion. A connecting rod is pivotally coupled to the crank for relative rotation about a proximal axis and to the piston for relative rotation about a distal axis. A first compression chamber exists in the cylinder distal portion beyond the end of the piston. A second compression chamber exists in the cylinder proximal portion beyond a piston shoulder. The first and second compression chambers are non-series and non-parallel.

In various implementations, a first inlet valve and a first outlet valve may be positioned along the first chamber. A second inlet valve and a second outlet valve may be positioned along the second chamber. At least one additional cylinder may be defined within the housing and has a single chamber. The second inlet valve and the second outlet valve may be positioned along the shoulder of the cylinder. A controller may be configured to control operation of the compressor in each of first and second modes of operation. In the first mode, the compressor compresses flow along a first flowpath segment through the first chamber but not a second flowpath segment through the second chamber. In the second mode, the compressor compresses flow along both the first and second flowpath segments. The compressor may be used with a carbon dioxide-based refrigerant. The compressor may be used to drive a dual economizer refrigeration system.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
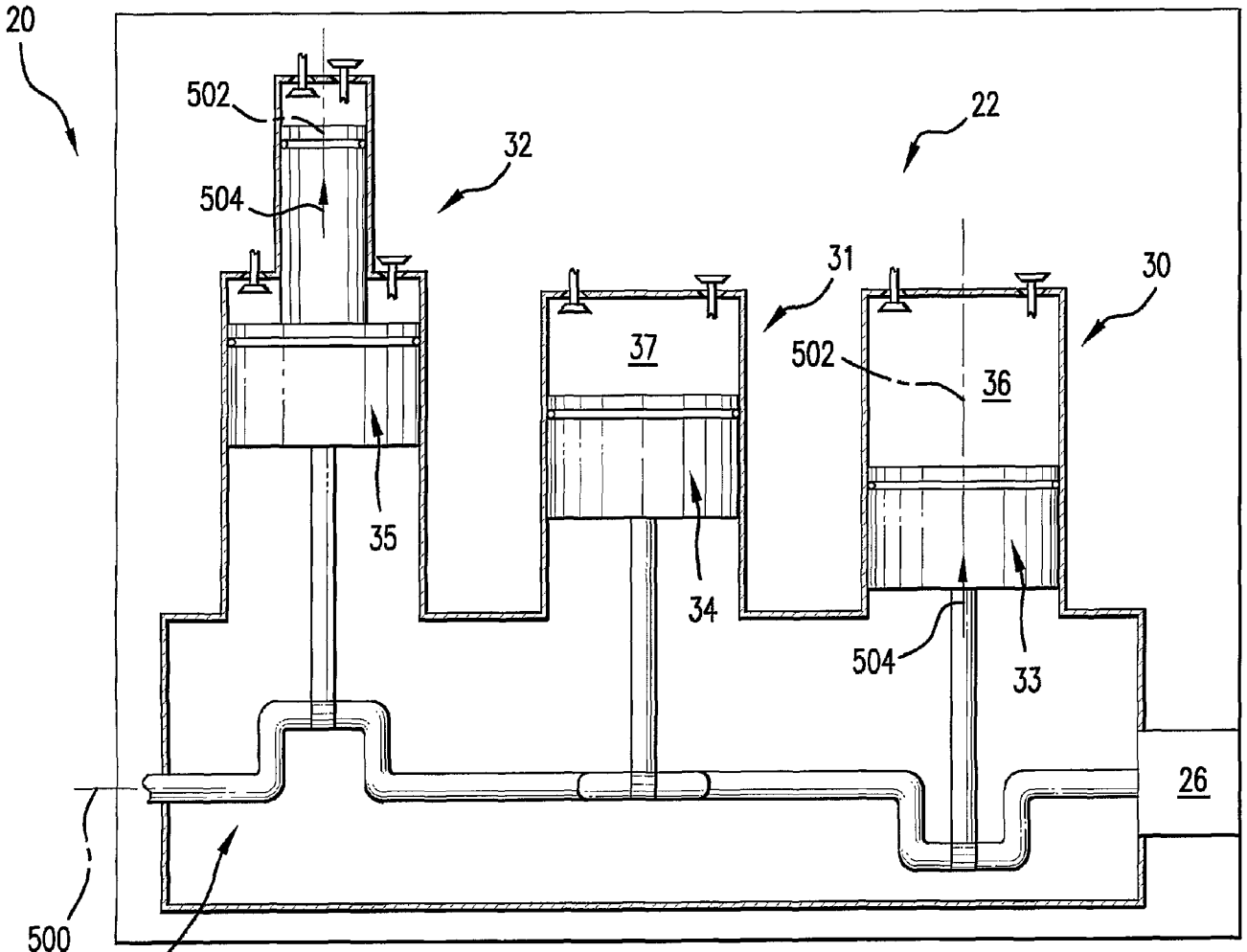
FIG. 1 is a partially schematic side view of a compressor.

FIG. 1 shows a compressor 20. The compressor has a housing assembly 22. A crankshaft 24 is mounted in the housing (e.g., via a plurality of bearings) (not shown) for rotation about an axis 500. A motor 26 is coupled to the crankshaft to drive the rotation of the crankshaft about the axis 500. The exemplary motor is an electric motor located within the housing. Alternative motors may be external to the housing.

The exemplary compressor is a reciprocating compressor wherein the housing defines a plurality of cylinders. Each cylinder accommodates an associated piston. Exemplary multi-cylinder configurations include: in-line; vee; and horizontally opposed. The exemplary compressor includes three cylinders 30, 31, and 32.

Each cylinder has a central axis 502 parallel to which an outward (distal) direction 504 is defined. Pistons 33, 34, and 35 are mounted at least partially in the associated cylinders 30, 31, and 32. Each piston is guided by its cylinder for relative motion in the outward direction 504 and back. As is discussed below, the exemplary cylinders 30 and 31 and pistons 33 and 34 are conventional non-stepped cylinders and pistons. Each of these two piston/cylinder combinations thus defines a single respective associated chamber or compression volume 36 and 37. As is discussed further below, the cylinder 32 and piston 35 are stepped to define two chambers or volumes.

Figure 2:
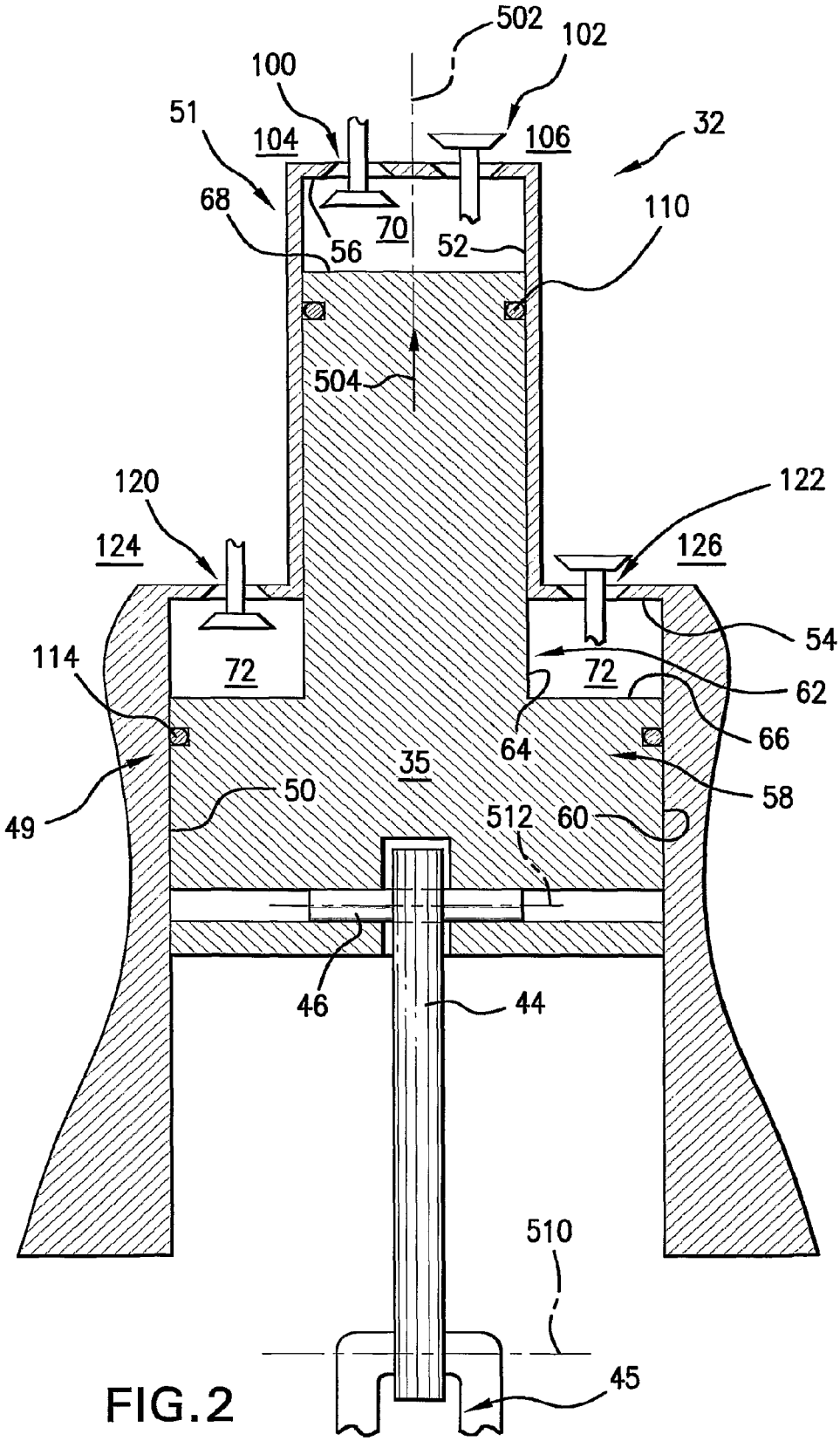
FIG. 2 is a sectional view of a stepped cylinder of the compressor of FIG. 1 with a piston at the top of its stroke.

FIG. 2 shows the piston 35 coupled to an associated connecting rod 44 which, in turn, is coupled to the crankshaft 24. Specifically, a crank portion 45 of the crankshaft 24 extends to a distal end portion pivotally mounted to a proximal end portion of the connecting rod 44 for relative rotation about a proximal axis 510. The connecting rod extends to a distal end portion coupled to the piston for relative rotation about a distal axis 512. The exemplary coupling is via a wrist pin 46 mounted in the piston and received in a complementary bore in the distal end portion of the connecting rod. Similar connecting rods and crankshaft crank portions are associated with the other pistons.

Figure 3:
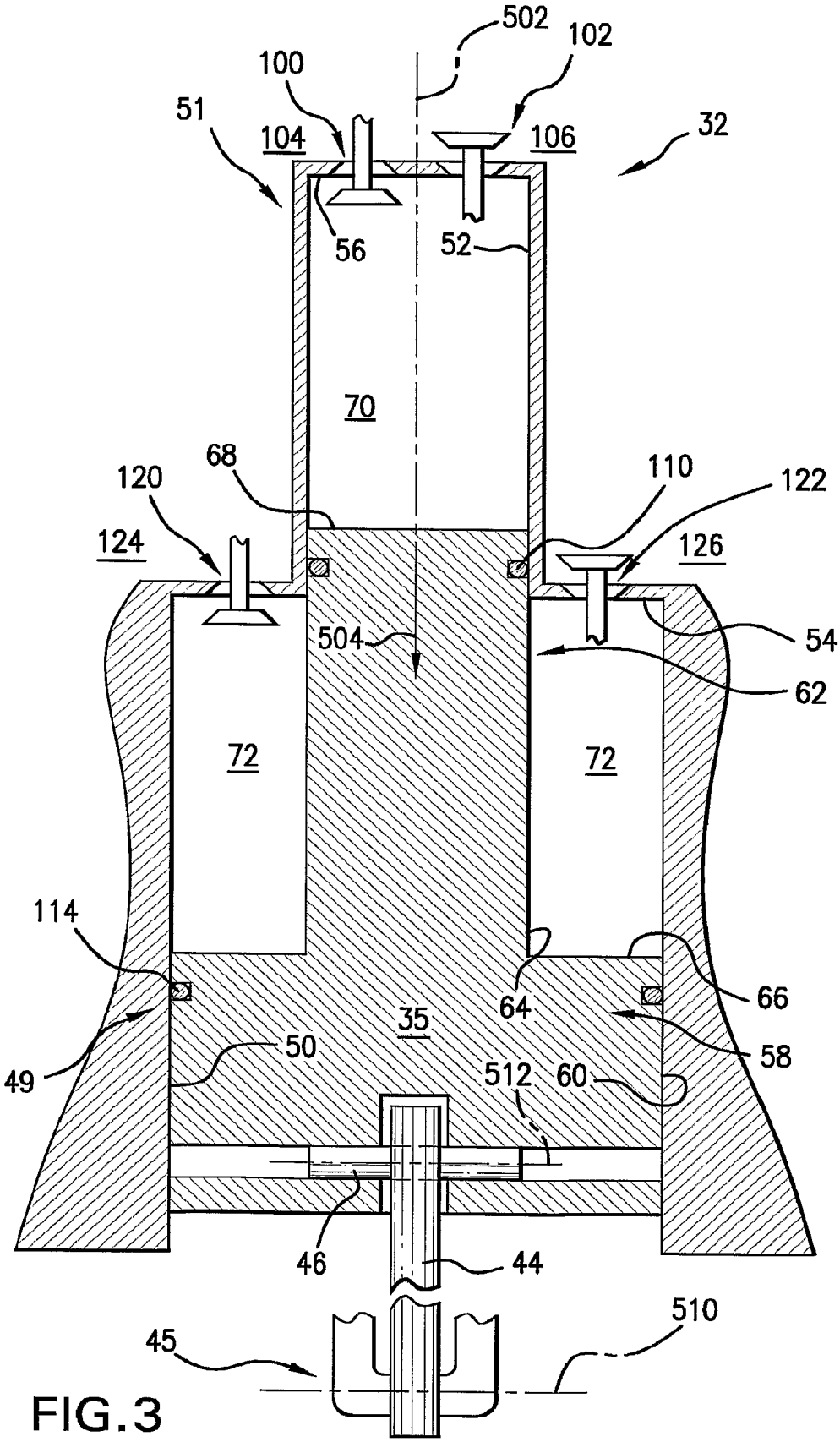
FIG. 3 is a sectional view of the cylinder of FIG. 2 with the piston at the bottom of its stroke.

As the motor rotates the crankshaft about its axis 500, the crank portion 45 and connecting rod 44 cooperate to reciprocally drive the piston between a topped position of FIG. 2 and a bottomed position of FIG. 3. The exemplary cylinder 32 has a stepped sidewall having a relatively large (i.e., in cross-sectional area normal to the cylinder axis 502) proximal portion 49 defined by a proximal sidewall surface 50. A relatively smaller cylinder distal portion 51 is defined by a sidewall distal sidewall surface 52. A shoulder surface 54 separates the sidewall proximal and distal surface portions. A head or top surface 56 spans a distal end of the cylinder distal portion 51. The piston similarly has a relatively large proximal portion 58 having a side/lateral surface 60 and a relatively small distal portion 62 having a side/lateral surface 64. A shoulder surface 66 connects the proximal and distal side/lateral surfaces. An end/face surface 68 forms a distal end of the piston at a distal (top) end of the distal portion 62. A distal chamber 70 is defined within the cylinder distal portion 51 beyond (above/outward of) the piston face 68. A proximal chamber 72 is defined within the cylinder proximal portion 49 between the piston and cylinder shoulder surfaces 66 and 54 and laterally of the adjacent region of the piston distal portion.

A first suction valve 100 and a first discharge valve 102 are positioned in the top surface 56 of the distal chamber 70 to selectively place the distal chamber in respective communication with a first suction location 104 and a first discharge location 106. Depending upon implementations, the suction and discharge locations 104 and 106 may be respective suction and discharge plenums. The exemplary valves 100 and 102 are poppet valves mounted along the head surface. The valves may be synchronized to the crankshaft (e.g., via mechanical or electronic means) to permit the compressor to pump a working fluid from the suction location to the discharge location or may be self-actuated by pressure differences between the distal chamber 70 and the respective suction and discharge locations 104 and 106. Exemplary self-actuated valves are free-floating or have a light spring pressure biasing them closed. They will remain closed with a pressure difference across them in one direction but will open with a small pressure difference in the other direction (i.e., the desired direction of flow). They may thus essentially be very fast-acting check valves. To maintain isolation of the distal chamber, the piston distal portion may carry one or more first sealing rings 110 positioned to sealingly engage with the cylinder sidewall distal surface 52 during the reciprocal movement of the piston.

According to the present invention, the proximal chamber 72 may also be used to provide an associated trapped volume for compressor use. In an exemplary implementation of this, the piston proximal portion is similarly sealed to the cylinder sidewall proximal surface (e.g., via one or more second sealing rings 114 carried along the piston proximal portion similar to rings of the other pistons). A second set of valves is positioned along the second chamber. The exemplary second set of valves includes a suction valve 120 and a discharge valve 122. The exemplary suction and discharge valves are also poppet valves mounted along the cylinder shoulder surface to selectively place the proximal chamber in respective communication with a second suction location 124 and a second discharge location 126 and are synchronized to the camshaft rotation or may be self-actuated as discussed above.

Various connection/operational implementations of the two-chamber cylinder are possible. The two chambers may be operated in parallel with each other. For example, the suction locations may be part of a common suction plenum and the discharge locations may be part of a common discharge plenum. The two may be operated in series with each other (e.g., one of the suction locations is coupled to one of the discharge locations). Via appropriate valves, the system may be configured to switch between parallel and series operation. Via appropriate valves and/or control of the suction and discharge valves, one or both of the chambers may be disabled from compression to provide a capacity control.

By presenting one or more stepped cylinder/piston combinations and one or more non-stepped combinations in a single compressor, advantageous flexibility of operation may be obtained at reasonable cost. The use of such a compressor also facilitates refrigeration systems that may make use of the compressor's operational flexibility.

Figure 4:
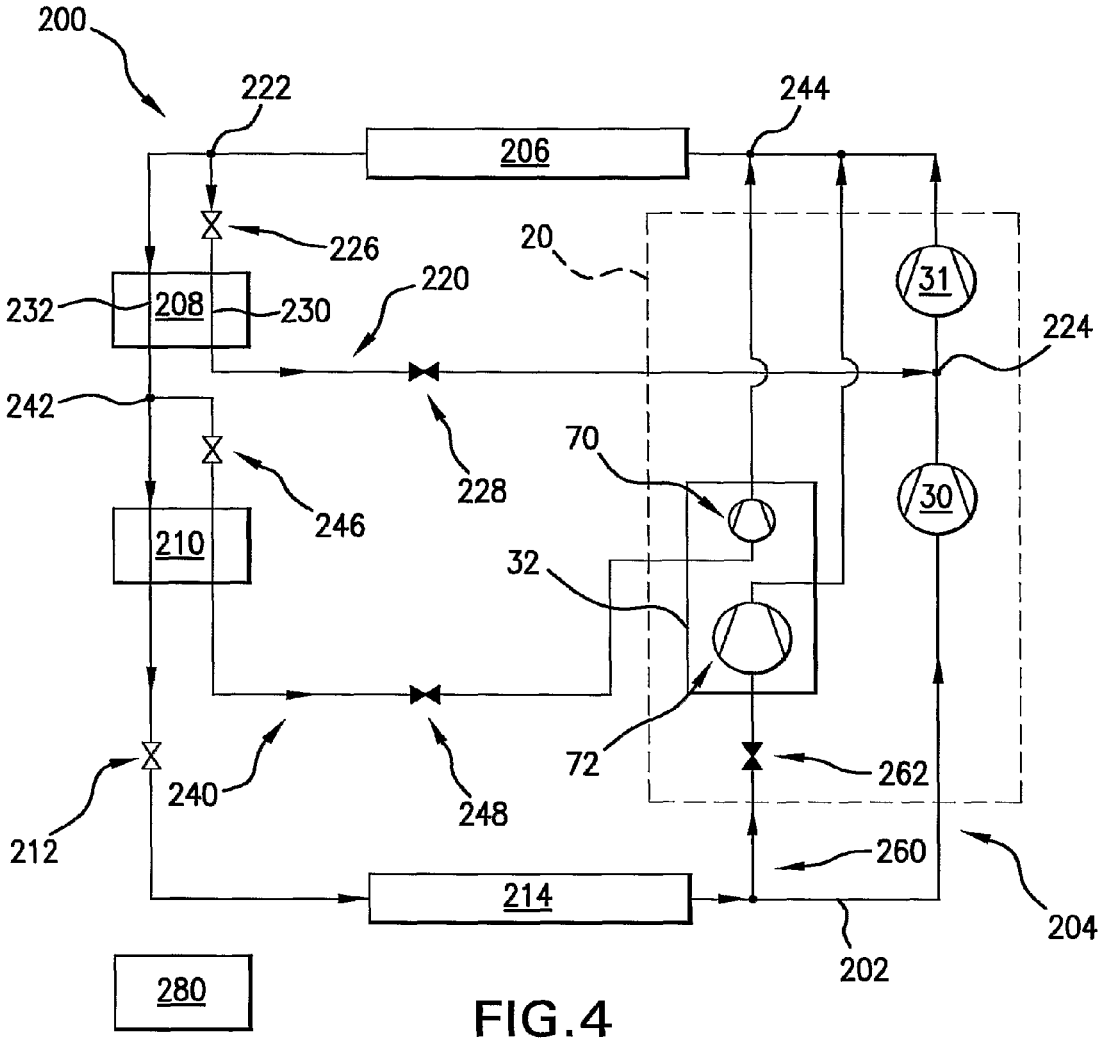
FIG. 4 is a schematic view of a refrigeration system including the compressor of FIG. 1.

FIG. 4 shows an exemplary refrigeration system 200 including the compressor 20. The system 200 includes a system suction location/condition 202 is at the suction location/condition of the first cylinder. A refrigerant primary flowpath 204 proceeds downstream from the suction location/condition 202 through the first cylinder 30 and then through the second cylinder 31 in series. The primary flowpath 204 proceeds downstream through the inlet of a first heat exchanger (heat rejection heat exchanger or gas cooler/condenser) 206 to exit the outlet of the gas cooler/condenser. The primary flowpath 204 proceeds downstream similarly through a first economizer heat exchanger (economizer) 208. The primary flowpath then proceeds downstream through a second economizer heat exchanger 210. The primary flowpath 204 then proceeds downstream through an expansion device 212. The primary flowpath then proceeds downstream through a second heat exchanger (heat absorption heat exchanger or evaporator) 214 to return to the suction condition/location 202.

In a normal operating condition, a recirculating flow of refrigerant passes along the primary flowpath 204, being compressed in the first and second cylinders 30 and 31. The compressed refrigerant is cooled in the gas cooler/condenser 206, expanded in the first expansion device 212, and then heated in the evaporator 214. In an exemplary implementation, the gas cooler/condenser 206 and evaporator 214 are refrigerant-air heat exchangers with associated fan-forced air flows. The evaporator 214 may be in the refrigerated space or its airflow may pass through the refrigerated space. Similarly, the gas cooler/condenser 206 or its airflow may be external to the refrigerated space.

The exemplary system 200 includes a first economizer flowpath 220. The first economizer flowpath 220 branches from the primary flowpath at a location/condition 222 between the gas cooler/condenser outlet and first economizer inlet. The exemplary first economizer flowpath 220 returns to the refrigerant primary flowpath at a location/condition 224 between the first 30 and second 31 cylinders (e.g., at their respective outlet/discharge and inlet/suction conditions/locations). The first economizer flowpath 220 passes sequentially through a second expansion device 226, then the first economizer 208, and then a valve 228. A leg 230 of the first economizer flowpath 220 in the first economizer 208 is in heat transfer relation with a leg 232 of the refrigerant primary flowpath 204 within the first economizer 208. Thus, when the first economizer flowpath is active, refrigerant flow along the first economizer flowpath cools the refrigerant in the refrigerant primary flowpath in the first economizer.

The exemplary system 200 also includes a second economizer flowpath 240. The second economizer flowpath 240 branches from the primary flowpath 204 at a condition/location 242 between the first and second economizers. The second economizer flowpath 240 returns to the primary flowpath 204 at a condition/location 244 between the second cylinder 31 and the gas cooler/condenser 206. The second economizer flowpath 240 proceeds sequentially through a third expansion device 246, the second economizer 210, a valve 248, and one of the two chambers 70 and 72 of the stepped cylinder 32. Thus, when the second economizer flowpath is active, refrigerant flow along the second economizer flowpath cools the refrigerant in the refrigerant primary flowpath in the second economizer.

The exemplary system 200 also includes a branch flowpath 260. The branch flowpath 260 branches from the primary flowpath 204 between the evaporator outlet and first cylinder inlet (e.g., at the suction condition/location 202). The branch flowpath 260 passes sequentially through a valve 262 and the other of the two chambers of the stepped cylinder (e.g., 72 in the implementation), to rejoin the primary flowpath 204 between the second cylinder and gas cooler/condenser (e.g., at the condition/location 244). Additional system components and further system variations are possible.

The exemplary expansion devices 212, 226, and 246 may be fixed expansion devices, thermomechanically controlled expansion devices, or system-controlled expansion devices. For example, in various implementations, the first expansion device 212 may be an electronic expansion valve controlled by a control system 280 which may also control operation of the compressor, other valves, fans, and the like. The expansion devices 246 and 226 may be similar or may be fixed orifices. Alternatively, the devices may be thermal expansion valves with control bulbs appropriately mounted in the system. Exemplary valves 228 and 248 may be simple on-off valves, electronically controlled by the control system 280. The valve 262 may be similar or may be an adjustable valve to control a flow rate along the branch flowpath 260. The valve 262 may be positioned in the compressor as a suction cut-off valve at the compression chamber 72.

An exemplary implementation involves a system using $CO_2$ (R-744) as a refrigerant. Potential applications include transport refrigeration units (e.g., truck boxes, trailers, cargo containers, and the like) which require broad capabilities. A given unit configuration may be manufactured for multiple operators with different needs. Many operators will have the need to, at different times, use a given unit for transport of frozen goods and non-frozen perishables. An exemplary frozen goods temperature is about −10° F. or less and an exemplary non-frozen perishable temperature is 34-38° F. The operator will predetermine appropriate temperature for each of the two modes. Prior to a trip or series, the technician or driver will enter the appropriate one of the two temperatures. Other operators may have broader requirements (e.g., an exemplary overall range of −40-57° F.).

Figure 5:
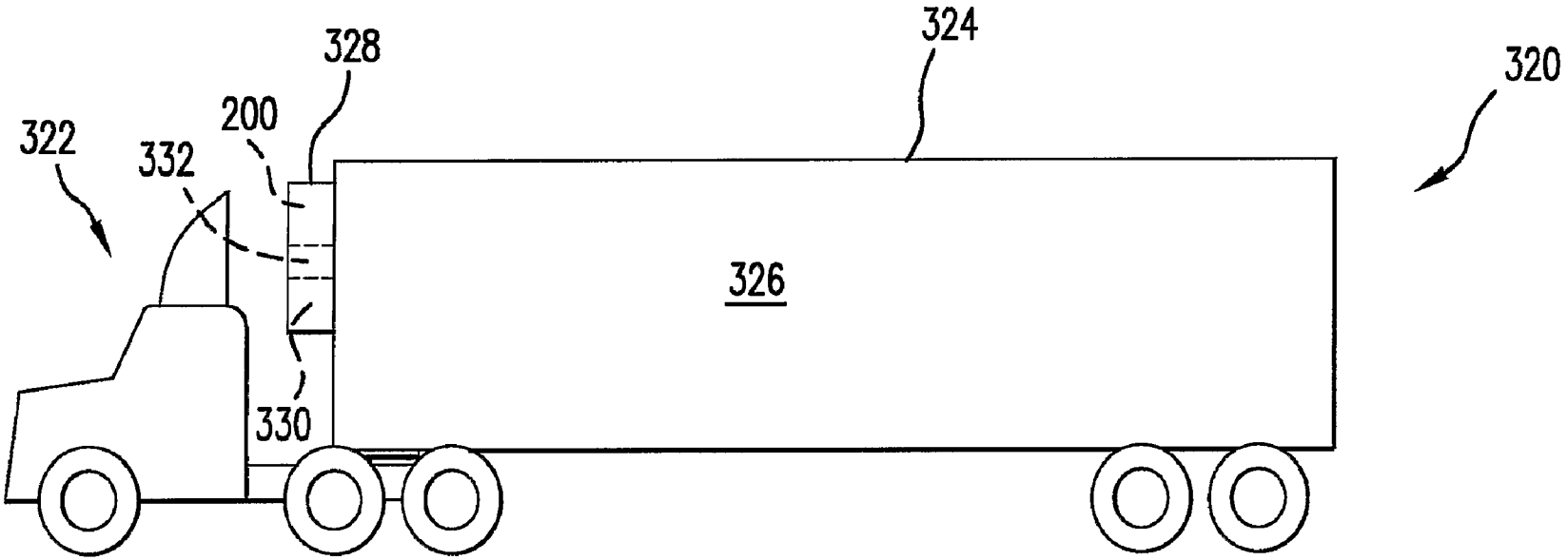
FIG. 5 is a view of a refrigerated transport unit.

FIG. 5 shows a refrigerated transport unit (system) 320 in the form of a refrigerated trailer. The trailer may be pulled by a tractor 322. The exemplary trailer includes a container/box 324 defining an interior/compartment 326. An equipment housing 328 mounted to a front of the box 324 may contain an electric generator system including an engine 330 (e.g., diesel) and an electric generator 332 mechanically coupled to the engine to be driven thereby. The refrigeration system 200 may be electrically coupled to the generator 332 to receive electrical power. The evaporator and its associated fan may be positioned in or otherwise in thermal communication with the compartment 326.

In operation, the first economizer flowpath 220 may be operated by the valve 228 to run the first economizer 208 as is well known in the art. Similarly, the valve 248 may be used to provide further economizer function. The valve 262 may be operated as a suction cutoff valve to its associated chamber of the stepped cylinder. When open, the valve 262 allows the associated chamber of the stepped cylinder to provide additional capacity to the system.

The operation of the valves 228, 248 and 262 depend on the controlled and ambient conditions and on the modes of operation. In an exemplary embodiment, the valves 226, 246, and 212 directly regulate flow based on a sensed parameter of the cycle. The valves 228 and 248 regulate the economization of the cycle under control of the controller 280. If either of valves 228 and 248 are open they improve the efficiency and capacity of the system. In an exemplary implementation, the valves 228 and 248 may be kept closed during system startup to prevent overloading of the compressor. The valves 228 and 248 may also be kept closed when a low capacity is required (e.g., a relatively high desired temperature of the cooled space such as in a non-frozen perishable cargo mode). When there is a requirement of additional capacity of the system like during pulldown or high controlled temperature condition or during a hot day the valve 262 is opened. Opening the valve 262 increases the refrigerant mass flow through evaporator, thereby increasing capacity. In systems where capacity improvement or adjustments are needed in precise amounts a modulating valve may be used for 262 and its operation modulated.

Various possible valve state combinations are shown in Table I below.

TABLE I

| | Valve State Combination | | | |
|---|---|---|---|---|
| Identifier | Valve 228 | Valve 248 | Valve 262 | Exemplary Situation(s) |
| 1 | closed | closed | closed | Low capacity/efficiency requirements (e.g., a non-frozen perishable mode) also for a short compressor start-up mode/phase (e.g., second to a few minutes) |
| 2 | open | closed | closed | High capacity requirements (e.g., a frozen food mode) but where current may limit the ability to have two-stage economization, thus only single stage economization is used |
| 3 | closed | open | closed | High capacity requirements (e.g., a frozen food mode) but where current may limit the ability to have two-stage economization, thus only single stage economization is used |
| 4 | open | open | closed | High capacity requirements (e.g., a frozen food mode) but where current does not limit the ability to have two-stage economization |
| 5 | closed | closed | open | Initial pulldown mode right after the initial compressor start-up phase |
| 6 | open | closed | open | Pulldown mode (e.g., after the initial pulldown when compartment temperatures have already dropped partially toward the setpoint and are low |

TABLE I-continued

| Valve State Combination | | | | |
|---|---|---|---|---|
| Identifier | Valve 228 | Valve 248 | Valve 262 | Exemplary Situation(s) |
| | | | | enough that the current draw is within design limits if only one economizer is operating) |
| 7 | closed | open | open | Pulldown mode (e.g., after the initial pulldown when compartment temperatures have already dropped partially toward the setpoint and are low enough that the current draw is within design limits if only one economizer is operating) |
| 8 | open | open | open | Pulldown mode (e.g., after the initial pulldown when compartment temperatures have already dropped partially toward the setpoint but are low enough that the current draw is within design limits with both economizers running) also in a post-pulldown high capacity mode (e.g., relatively high ambient temperatures) |

Subtle optimization considerations may differentiate between the choice of combination #2 vs. #3 and #6 vs. #7. The system may, however be configured via selection of economizer heat exchanger size and cylinder/chamber size to increase the differentiation between the combinations and their associated situations. Selection between the combinations may be made by the controller responsive to a combination pf pre-programming, user-set parameters, sensed parameters, and/or calculated parameters (e.g., current draws). Other factors that may influence the particular combination include compressor balance or vibration control.

In engineering the compressor, the displacements of the two chambers of the stepped cylinder and their respective compression ratios or volume indices may be selected for a variety of purposes. For example, the volume indices may be associated with the anticipated required pressure differences. The displacements may then be selected based upon desired relative flow rates. In one example, the volume indices are each the same as those of the non-stepped cylinders. This allows either of the chambers to conveniently be operated in parallel with the other cylinders. Alternatively, the volume indices may be greater than that of the other cylinders individually but equal to or less than the effective series combination of the other cylinders. This allows the chamber(s) to be operated in parallel with the series combination of the other cylinders.

The relative sizes of the cylinders/chambers 30, 31, and 70 help control the pressures in the flowpaths 220 and 240 relative to the evaporator and gas cooler/condenser pressures and thereby help optimize the efficiency of the system. However, the actual sizes of the cylinders/chambers 31, 32, 70, and 72 determine the capacity of the system. In an exemplary implementation, the first cylinder 30 is bigger than the second cylinder 31, which in turn is bigger than the chamber 70. The size of chamber 72 may merely be what is effectively available in view of the selected size of the chamber 70. The pressure ratios of the various cylinders/chambers may reflect desired performance issues.

One or more embodiments of the present invention have been described. Nevertheless, it will be understood that various modifications may be made without departing from the spirit and scope of the invention. For example, when implemented in the reengineering of an existing compressor configuration or remanufacturing of an existing compressor, details of the baseline configuration may influence or dictate details of any particular implementation. Accordingly, other embodiments are within the scope of the following claims.

What is claimed is:

1. A compressor (20) comprising:

a housing (22);

a crank (24) carried by the housing for rotation about a crank axis (500); and a plurality of cylinders (30, 31, 32) defined within the housing, each said cylinder having:

an associated piston (33, 34, 35) held within the housing for reciprocal movement at least partially within the cylinder; and a connecting rod (44) pivotally coupled to the crank (24) for relative rotation about a proximal axis (510) and to said associated piston for relative rotation about a distal axis (512), wherein:

a first (30) of the cylinders has a single associated chamber (36);

a stepped cylinder (32) of the cylinders has a proximal portion (49) and a distal portion (51) separated by a shoulder (54), the distal portion being smaller than the proximal portion in cross-sectional area transverse to a cylinder axis (502);

the piston (35) associated with the stepped cylinder has a proximal portion (58) and a distal portion (62), the distal portion (62) smaller than the proximal portion (58) in cross-sectional area transverse to the cylinder axis (502);

a first compression chamber (70) exists in the cylinder distal portion beyond the end of the piston;

a second compression chamber (72) exists in the cylinder proximal portion beyond the piston shoulder, the first and second compression chambers being not in series and not in parallel.

2. The compressor of claim 1 further comprising:

a suction cutoff valve (262) positioned to selectively block flow through the second compression chamber (72) without blocking flow through the first compression chamber (70).

3. The compressor of claim 1 further comprising:

a first inlet valve (100) and first outlet valve (102) positioned along the first compression chamber; and a second inlet valve (120) and second outlet valve (122) positioned along the second compression chamber.

4. The compressor of claim 1 further comprising:

a controller configured to control operation of the compressor to provide:

a first mode of operation in which the compressor compresses flow along a first flowpath segment through the first chamber but not a second flowpath segment through the second chamber; and a second mode of operation in which the compressor compresses flow along both the first and second flowpath segments.

5. A refrigeration system comprising:

the compressor of claim 1;

a heat rejection heat exchanger downstream of the compressor along a primary refrigerant flowpath;

an expansion device downstream of the heat rejection heat exchanger along the primary refrigerant flowpath; and a heat absorption heat exchanger downstream of the expansion device along the primary refrigerant flowpath.

6. A method for operating the compressor of claim 4 wherein:

in the second mode, the compression is non-series along the first and second flowpaths.

7. The method of claim 6 wherein:

in the second mode, the compression along the first and second flowpaths is to a common discharge condition.

8. The method of claim 6 wherein:

in the second mode, compression along the second flowpath is parallel to a series combination of the first cylinder and a third said cylinder.

9. A method for operating a compressor, the compressor having:

a housing;

a crank carried by the housing for rotation about a crank axis;

a stepped cylinder defined within the housing and having a proximal portion and a distal portion separated by a shoulder, the distal portion being smaller than the proximal portion in cross-sectional area transverse to the cylinder axis;

a stepped piston held within the housing for reciprocal movement at least partially within the cylinder and having a proximal portion and a distal portion, the distal portion smaller than the proximal portion in cross-sectional area transverse to the cylinder axis;

a connecting rod pivotally coupled to the crank for relative rotation about a proximal axis and to the piston for relative rotation about a distal axis;

a first chamber in the cylinder distal portion beyond the end of the piston; and a second chamber in the cylinder proximal portion beyond the piston shoulder; and at least one unstepped cylinder (30;31) defined within the housing;

at least one unstepped piston (33;34) held within the housing for reciprocal movement at least partially within an associated said unstepped cylinder and coupled to the crank;

the method comprising:

admitting first and second flows respectively to the first and second chambers;

compressing the first and second flows; and discharging the first and second flows, the flows joining at only one of suction and discharge conditions.

10. The method of claim 9 wherein:

the admitting comprises drawing the piston in a proximal direction via the crank; and the compressing comprises driving the piston in a distal direction via the crank.

11. The method of claim 9 wherein:

the admitting and discharging are in common to a discharge plenum.

12. A refrigeration system comprising:

a reciprocating compressor (20) having a plurality of cylinders (30, 31, 32) including at least one stepped cylinder (32) having a first chamber (70) and a second chamber (72);

a heat rejection heat exchanger (206) downstream of the compressor along a refrigerant primary flowpath;

an expansion device (212) downstream of the heat rejection heat exchanger along the refrigerant primary flowpath;

a heat absorption heat exchanger (214) downstream of the expansion device along the refrigerant primary flowpath; and a plurality of economizer flowpaths (220; 240) branching from the primary flowpath at least one passing through at least one of the first (70) and second (72) chambers.

13. The system of claim 12 wherein:

a first (30) of the cylinders has a single associated chamber (36);

a second (31) of the cylinders has a single associated chamber (37);

the primary flowpath (204) extends sequentially through:

the first cylinder (30);

the second cylinder (31);

the heat rejection heat exchanger (206);

a first economizer (208);

a second economizer (210);

the expansion device (212); and the heat absorption heat exchanger (214) to return to the first cylinder (30);

a first said economizer flowpath (220) branches from the primary flowpath (204) between the heat rejection heat exchanger (206) and first economizer (208) and returns to the primary flowpath (204) between the first and second cylinders and extends through:

a second expansion device (226); and the first economizer (208);

a second said economizer flowpath (240) branches from the primary flowpath (204) between the first economizer (208) and the second economizer (210) and returns to the primary flowpath (204) between the second cylinder (31) and the heat rejection heat exchanger (206) and extends through:

a third expansion device (246);

the second economizer (210); and one (70) of the first and second chambers; and an additional branch flowpath (260) branches from the primary flowpath (204) between the heat absorption heat exchanger (214) and the first cylinder (30) and returns to the primary flowpath (204) between the second cylinder (31) and the heat rejection heat exchanger (206) and extends through the other (72) of the first and second chambers.

14. The system of claim 13 wherein:

a suction cutoff valve (262) is in the additional branch flowpath (260) upstream of the other chamber (72).

15. The system of claim 13 wherein:

a suction cutoff valve (262) is in the additional branch flowpath upstream of the other chamber;

a first valve (228) is along the first economizer flowpath (220); and a second valve (248) is along the second economizer flowpath (240).

16. A refrigeration system comprising:
a compressor (20) comprising:
a housing (22);
a crank (24) carried by the housing for rotation about a crank axis (500); and
a plurality of cylinders (30, 31, 32) defined within the housing, each said cylinder having:
an associated piston (33, 34, 35) held within the housing for reciprocal movement at least partially within the cylinder; and
a connecting rod (44) pivotally coupled to the crank (24) for relative rotation about a proximal axis (510) and to said associated piston for relative rotation about a distal axis (512),
wherein:
a first (30) of the cylinders has a single associated chamber (36);
a stepped cylinder (32) of the cylinders has a proximal portion (49) and a distal portion (51) separated by a shoulder (54), the distal portion being smaller than the proximal portion in cross-sectional area transverse to a cylinder axis (502);
the piston (35) associated with the stepped cylinder has a proximal portion (58) and a distal portion (62), the distal portion (62) smaller than the proximal portion (58) in cross-sectional area transverse to the cylinder axis (502);
a first chamber (70) exists in the cylinder distal portion beyond the end of the piston;
a second chamber (72) exists in the cylinder proximal portion beyond the piston shoulder;
a first inlet valve (100) and first outlet valve (102) are positioned along the first chamber; and
a second inlet valve (120) and second outlet valve (122) are positioned along the second chamber;
a heat rejection heat exchanger (206) downstream of the compressor along a refrigerant primary flowpath;
an expansion device (212) downstream of the heat rejection heat exchanger along the refrigerant primary flowpath;
a heat absorption heat exchanger (214) downstream of the expansion device along the refrigerant primary flowpath; and
a plurality of economizer flowpaths (220; 240) branching from the primary flowpath at least one passing through at least one of the first (70) and second (72) chambers.

17. The system of claim 16 wherein a refrigerant charge comprises at least 50%, by weight, carbon dioxide.

18. The system of claim 16 further comprising:
an internal combustion engine-powered generator (330, 332) coupled to the compressor to power the compressor.

19. The system of claim 16 wherein:
the second inlet valve and second outlet valve are positioned along the shoulder of the cylinder.

20. The system of claim 16 wherein:
a compression ratio of the first chamber is identical to a compression ratio of the second chamber.

21. The system of claim 16 wherein:
a second (31) of the cylinders has a single associated chamber (37);
the primary flowpath (204) extends sequentially through:
the first cylinder (30);
the second cylinder (31);
the heat rejection heat exchanger (206);
a first economizer (208);
a second economizer (210);
the expansion device (212); and
the heat absorption heat exchanger (214) to return to the first cylinder (30);
a first said economizer flowpath (220) branches from the primary flowpath (204) between the heat rejection heat exchanger (206) and first economizer (208) and returns to the primary flowpath (204) between the first and second cylinders and extends through:
a second expansion device (226); and
the first economizer (208);
a second said economizer flowpath (240) branches from the primary flowpath (204) between the first economizer (208) and second economizer (210) and returns to the primary flowpath (204) between the second cylinder (31) and the heat rejection heat exchanger (206) and extends through:
a third expansion device (246);
the second economizer (210); and
one (70) of the first and second chambers; and
an additional branch flowpath (260) branches from the primary flowpath (204) between the heat absorption heat exchanger (214) and the first cylinder (30) and returns to the primary flowpath (204) between the second cylinder (31) and the heat rejection heat exchanger (206) and extends through the other (72) of the first and second chambers.

22. The system of claim 21 wherein:
a suction cutoff valve (262) is in the additional branch flowpath upstream of the other chamber.

23. The system of claim 21 wherein:
a suction cutoff valve (262) is in the additional branch flowpath upstream of the other chamber;
a first valve (228) is along the first economizer flowpath (220); and
a second valve (248) is along the second economizer flowpath (240).

24. A method for operating the system of claim 23 comprising:
running the compressor in a first mode of operation wherein:
the suction cutoff valve (262) is open; and
the second chamber (72) is used to compress refrigerant essentially in parallel with a series combination of the first cylinder (30) and the second cylinder (31); and
running the compressor in a second mode of operation wherein:
the suction cutoff valve (262) is closed;
the second chamber (72) is unused; and
a series combination of the first cylinder (30) and the second cylinder (31) is used to compress refrigerant.

25. A method for operating the system of claim 23 comprising:
running in a start-up phase with the suction cutoff valve (262) closed, the first valve (228) is closed, and the second valve (248) is closed; and
running in a pulldown mode with the suction cutoff valve (262) open, the first valve (228) is closed, and the second valve (248) is closed.

26. The method of claim 25 further comprising:
running in a first dual economized mode with the suction cutoff valve (262) closed, the first valve (228) is open, and the second valve (248) is open; and
running in a second dual economized mode with the suction cutoff valve (262) open, the first valve (228) is open, and the second valve (248) is open.

27. A method for operating the system of claim 16 comprising:

running the compressor in a first mode of operation in which the compressor compresses flow along a first flowpath segment through the first chamber but not a second flowpath segment through the second chamber; and running the compressor in a second mode of operation in which the compressor compresses flow along both the first and second flowpath segments.

28. The method of claim 27 wherein:

in the second mode, the compression along the first and second flowpaths is to a common condition (244).

29. A method for operating a compressor, the compressor having:

a housing;

a crank carried by the housing for rotation about a crank axis;

a stepped cylinder defined within the housing and having a proximal portion and a distal portion separated by a shoulder, the distal portion being smaller than the proximal portion in cross-sectional area transverse to the cylinder axis;

a stepped piston held within the housing for reciprocal movement at least partially within the cylinder and having a proximal portion and a distal portion, the distal portion smaller than the proximal portion in cross-sectional area transverse to the cylinder axis;

a connecting rod pivotally coupled to the crank for relative rotation about a proximal axis and to the piston for relative rotation about a distal axis;

a first chamber in the cylinder distal portion beyond the end of the piston; and a second chamber in the cylinder proximal portion beyond the piston shoulder; and at least one unstepped cylinder (30;31) defined within the housing;

at least one unstepped piston (33;34) held within the housing for reciprocal movement at least partially within an associated said unstepped cylinder and coupled to the crank;

the method comprising:

admitting a refrigerant primary flow to the at least one unstepped cylinder;

admitting first and second additional flows respectively to the first and second chambers;

compressing the refrigerant primary flow and the first and second flows; and discharging the refrigerant primary flow and the first and second flows at a common condition (244).

30. The method of claim 29 wherein:

the first additional flow is an economizer flow; and the second additional flow is from a suction condition in common with the refrigerant primary flow.

31. The method of claim 29 wherein:

there are first and second said unstepped cylinders;

the refrigerant primary flow passes sequentially through the first and second unstepped cylinders; and another economizer flow enters an interstage of the first and second unstepped cylinders.

* * * * *